United States Patent [19]

Coffman et al.

[11] 3,974,080

[45] Aug. 10, 1976

[54] SILICONE HYDRAULIC FLUIDS

[75] Inventors: Robert Lee Coffman, Mahopac; Richard Welty Shiffler, Briarcliff Manor, both of N.Y.

[73] Assignee: Union Carbide Corporation, New York, N.Y.

[22] Filed: Oct. 29, 1975

[21] Appl. No.: 626,703

[52] U.S. Cl. ..... 252/78.3

[51] Int. Cl.[2] ..... C10M 3/44; C09N 3/00

[58] Field of Search ..... 252/78; 49.9

[56] References Cited

UNITED STATES PATENTS

| | | | |
|---|---|---|---|
| 2,624,749 | 1/1953 | Bunnell | 260/448.8 R |
| 2,723,237 | 11/1955 | Ferrin | 252/49.8 |
| 2,750,342 | 6/1956 | Mikeska et al. | 252/46.6 |
| 2,909,549 | 10/1959 | Bailey | 260/448.8 R |
| 3,317,428 | 5/1967 | Pater | 252/75 |
| 3,340,191 | 9/1967 | White et al. | 252/49.8 |
| 3,479,290 | 11/1969 | Brown | 252/49.9 |
| 3,769,221 | 10/1973 | Burrous | 252/78 |
| 3,821,114 | 6/1974 | Brown | 252/78 |
| 3,833,505 | 9/1974 | Brown | 252/78 |

*Primary Examiner*—Harris A. Pitlick
*Attorney, Agent, or Firm*—Bernard Francis Crowe

[57] ABSTRACT

Hydraulic fluids having excellent water tolerance at −40°C. are provided by a mixture of an alkoxysiloxane and a glycol ether phosphoric acid ester.

12 Claims, No Drawings

SILICONE HYDRAULIC FLUIDS

BACKGROUND OF THE INVENTION

This invention pertains to hydraulic fluids and in particular to those having excellent water tolerance at −40°C.

Power transmission or hydraulic fluids, and particularly brake fluids are subject to moisture contamination which may arise because of the inherent hygroscopicity of the hydraulic fluid, from condensation of moisture from the air or from physical leakage or defects in the hydraulic system which permits the entry of water. The deleterious effects arising from moisture contamination of hydraulic fluids include lowering of boiling points, vapor locking, corrosion, hydrolysis, foaming, sludging, freezing and the like. Such contamination is especially serious in on- and off-highway automotive central hydraulic system fluids which function in any one or a combination of power units engineered to operate windows, seats, steering mechanisms, brakes, aerials, starters and the like. Federal Motor Vehicle Safety Standard No. 116 as published in the Federal Motor Vehicle Safety Standards and Regulations, Supplement 80, dated Oct. 23, 1974 lays down specific requirements for hydraulic brake fluids including test procedures such as S5.1.9 for water tolerance. This regulation requires that in accordance with test S6.9.1 and S6.9.3 a DOT 5 brake fluid when humidified and stored at −40°C. for 120 hours shall show no sludging, sedimentation, crystallization, or stratification.

The use of non-petroleum types of materials as hydraulic fluids was initiated because of the need for compatibility with the natural rubber and synthetic rubber seals used in hydraulic systems, such as for example those used in automotive brake systems. Among the newer types of hydraulic fluids examined in recent years are the silicone brake fluids which meet many of the swell, boiling point, corrosion and other properties but do not meet the water tolerance test for DOT 5 silicone brake fluids enumerated above.

It is therefore an object of this invention to provide silicone hydraulic fluids which meet the water tolerance requirements of DOT 5 silicone type brake fluids.

Other objects will become apparent to those skilled in the art upon a reading of the specification.

SUMMARY OF THE INVENTION

Hydraulic fluid compositions meeting the water tolerance requirements for DOT 5 silicone type brake fluids have been formulated from a mixture which comprises:

A. about 50 to about 99% by weight of and alkoxysiloxane having the formula:

$$RO[(CH_3)_2SiO]_nR$$

wherein R is a monovalent hydrocarbon group or a mixture of monovalent hydrocarbon groups, derived from an aliphatic alcohol or a mixture of aliphatic alcohols, respectively, having the formula ROH by removal of the hydroxyl group, said alcohol or mixture of alcohols having a boiling point above about 78 °C. at atmospheric pressure, and wherein $n$ is an integer having values of about 5 to about 200; and B. 1 to about 50% by weight of a phosphoric acid ester having the formula:

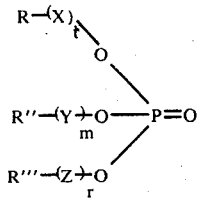

wherein each of R′, R″ and R‴ is a lower alkyl group having one to six carbon atoms, X, Y and Z are oxyalkylene units, including mixed oxyalkylene units having the formula:

$$-(OC_pH_{2p})-$$

wherein $t$, $m$ and $r$ are integers having values of 2 to 4 and $p$ is an integer having values of 2 to 3.

In addition this invention provides a process for transmitting force in an hydraulic system and particularly in an hydraulic brake system of a vehicle having activating means, activated means, master brake cylinder means, and hydraulic line means connecting said activating means, said activated means and said master brake cylinder means. This process comprises applying mechanical force to said activating means wherein said activating means, said activated means, said master brake cylinder means, and said hydraulic line means are substantially filled with the hydraulic fluid composition described in the preceding paragraph.

DESCRIPTION OF THE INVENTION

The alkoxysiloxanes of this invention can be prepared by reacting a dimethylsiloxane hydrolyzate with a suitable alcohol or mixture of alcohols in the presence of a basic catalyst (e.g., potassium hydroxide) and aromatic solvent (e.g., xylene) at an elevated temperature (e.g., from 100° to 150°C). The dimethylsiloxane hydrolyzate employed in producing the alkoxysiloxanes of this invention can be prepared by the hydrolysis of dimethyldichlorosilane in the presence of hydrochloric acid by conventional techniques. The hydrolyzate so produced consists of a mixture of cyclic dimethylsiloxanes and linear hydroxyl endblocked dimethylsiloxanes. The alcohol reactants used in producing alkoxysiloxane for this invention are commercially available or can be prepared by a 2-step process. The first step is the oxo or hydroformylation reaction of olefins with carbon monoxide and hydrogen in the presence of a catalyst to produce an aldehyde intermediate. The second step is the hydrogenation of the intermediate to produce the alcohol. This 2-step process produces mixtures of alcohol (e.g., mixtures of isomeric isodecanols and mixtures of isomeric tridecanols). Alternatively, suitable alcohols can be produced by other processes that provide individual alcohols, e.g., ethanol, isopropanol, isobutanol, 3-methyl-1-butanol, 2-ethylhexanol, and the like. The alcohols have from 2 to 18 carbon atoms and preferably from 10 to 14 carbon atoms.

The alkoxysiloxanes described above may be employed in the hydraulic fluids of this invention as such or containing a minor amount of unreacted alcohols. Such mixtures may contain from 70 to 98 parts by weight of the alkoxysiloxane and from 30 to 2 parts by weight of unreacted alcohol per 100 parts by weight of the alkoxysiloxane-alcohol mixture.

The uniqueness of the instant invention is evinced by the fact that a closely related class of silicone oils having the formula $$(CH_3)_3SiO[(CH_3)_2SiO]_xSi(CH_3)_3$$

wherein $x$ represents a number of repeating units extending from 5 to about 200 are not compatible with the glycol ether phosphoric acid esters of this invention and do not prevent the formation of ice crystals in the test conditions required for a DOT 5 silicone brake fluid.

The nature of the glycol ether phosphoric acid esters used in the brake fluid formulations of this invention is also narrowly critical in that a number of other esters are completely unacceptable. Exemplary esters which cannot be used include trialkyl phosphates such as trioctyl phosphate; alkyl dibasic aliphatic acid esters such as di-2-ethyl adipate, di-2-ethyl sebecate, dibutyl Cellosolve adipate, and the like; alkyl ether dibasic aromatic acid esters, such as, dimethyl Cellosolve phthalate, dibutyl Cellosolve phthalate, diethoxyethoxyethyl phthalate, and the like; glycol ether monobasic aliphatic acid esters, such as, tetraethylene glycol octoate, triethylene octoate, methyl Cellosolve acetyl ricinoleate; and triaryl phosphates, such as, Cellulube 90 and the like.

Although the alkyl groups represented by the symbols R′, R″ and R‴, in the formula above may have 1 to 6 carbon atoms, it is preferred to use those having 4 carbon atoms such as n-butyl or isobutyl.

Although the groups X, Y and Z in the phosphoric acid ester formula above may contain from 1 to 4 oxyalkylene units, it is preferred for commercial reasons to employ phosphoric acid esters where X, Y and Z each contain one oxyalkylene unit. Where available of course the di, tri and tetra oxyalkylene units may also be used derived from either ethylene oxide or propylene oxide or mixture thereof.

The phosphoric acid esters of this invention can be prepared by the esterification of one mole of phosphoric acid with three moles of an appropriate glycol ether, by esterification techniques well known in the art. Suitable glycol ethers include: methyl Cellosolve, ethyl Cellosolve, n-propyl Cellosolve, isopropyl Cellosolve, n-butyl Cellosolve, isobutyl Cellosolve, and the like (Cellosolve being a Trademark for monoalkyl ethers of ethylene glycol); methyl Carbitol, ethyl Carbitol, isopropyl Carbitol, n-propyl Carbitol, n-butyl Carbitol, isobutyl Carbitol, and the like (Carbitol being a Trademark for monoalkyl ethers of diethylene glycol); methoxy, ethoxy, n-propoxy, isopropoxy, n-butoxy and isobutoxy monoethers of triethylene glycol or tetraethylene glycol; methoxy ethoxy, n-propoxy, isopropoxy, n-butoxy and isobutoxy monoethers of propylene glycol, dipropylene glycol, tripropylene glycol and tetrapropylene glycol; and mixtures of any of the above.

One preferred phosphoric ester tributyl Cellosolve phosphate is commercially available from FMC Corp.

Up until the discovery of the present invention all known essentially water-intolerant DOT 5 silicone type fluids exhibited crystal formation in the water tolerance test at −40°C. Fluids in which crystals can form under these conditions are considered unsafe because the crystals can plug up the small orifices in a brake system and thereby impede or stop the flow of hydraulic fluid through the hydraulic line from the master cylinder to the wheel cylinders. An orifice in the master cylinder has a very small diameter, namely 0.025 inches. The DOT 5 silicon-type brake fluids of the instant invention overcome the deficiencies exhibited by other silicone fluids by imparting the necessary water tolerance at −40°C. so that crystal growth does not occur. The stratification of the brake fluid components into separate layers is also precluded. The phosphoric acid esters used in the hydraulic fluid formulations of this invention act not only as couplers for absorbed water but serve a secondary purpose in acting as rubber swelling modifiers, that is, they impart a desired balance of rubber swelling characteristics for a wide variety of rubber compositions, both natural and synthetic, to provide adequate sealing of the braking system.

The components of this invention can be blended by conventional mixing equipment known to those skilled in the art.

The rubber swell of standard styrene-butadiene or neoprene rubber test cups exposed to the hydraulic fluid compositions of this invention as well as Control formulations were measured in conformity with Federal Motor Vehicle Safety Standard No. 116, paragraph S4.1.13.

The appearance of the various test fluids after humidification for 6 days at −40°C. in conformity with the Motor Vehicle Safety Standard No. 116, paragraphs S5.19, S6.9.1 and S6.9.3 is presented in the Examples which follow. All parts and percentages are by weight unless otherwise specified.

The alkoxysiloxanes used in the hydraulic fluid compositions of this invention were prepared according to the general method presented below in which the following starting materials were used:

Dimethylsiloxane-hydrolyzate: This starting material is prepared by the hydrolysis of dimethyldichlorosilane with concentrated hydrochloric acid at a temperature of 80° to 90°C. The resulting intermediate is a mixture of cyclic dimethylsiloxanes and chloro endblocked dimethylsiloxanes. The intermediate is neutralized using aqueous base at a temperature of 70° to 90°C. The product so obtained is washed with water to produce the dimethylsiloxane hydrolyzate which has a viscosity of 18 to 30 centistokes at 25°C. and an hydroxyl content of 0.5 to 1.0. The hydrolyzate consists of about 50% by weight of cyclic dimethylsiloxanes and about 50% by weight of hydroxyl endblocked dimethylsiloxanes.

Tridecanol Mixture: This starting material is a mixture of alcohols produced by the conventional oxo and reduction processes. The mixture of alcohols consists of about 5% by weight of $C_{11}$ alcohols, 20 percent by weight of $C_{12}$ alcohols, 64% by weight of $C_{13}$ alcohols and 10% by weight of $C_{14}$ alcohols. The alcohols are highly branched primary alcohols. The alcohol mixture has a boiling point of 257.6°C. at atmospheric pressure and a pour point of −40°C.

Isodecanol Mixture: This starting material is a mixture of alcohols produced by the conventional oxo and reduction processes. The alcohols in this mixture have an average of about 10 carbon atoms and are highly branched primary alcohols. This alcohol mixture has a boiling point of 220°C. at atmospheric pressure and becomes glassy at −51°C.

ALKOXYSILOXANE PREPARATION I

A typical alkoxysiloxane used in this invention was prepared as follows. A 500 ml 3-neck flask equipped with a Dean-Stark water trap, a mechanical stirrer and an automatic temperature controller was charged with 2 to 5 grams of a dimethylsiloxane hydrolyzate, 75 grams of a tridecanol mixture, 1.5 grams of KOH and 50 ml of xylene. The reactants were heated to 150°C. and the xylene-water azeotrope was removed over a period of 3 hours. The crude product so produced was cooled, and neutralized with carbonate and filtered to yield an alkoxysilane having an average formula:

$$C_{13}H_{27}O[(CH_3)_2SiO]_{11.5}C_{13}H_{27}$$

The volatile components (the xylene and small amounts of unreactive hydrolyzate and alcohol) were removed under vacuum at 150°C. The alkoxysiloxane product had a boiling point above 316°C. and a viscosity at 210°F. (98.5°C.) of 8.0 centistokes, at 100°F. (37.5°C.) of 22.9 centistokes, at −40°C. of 430 centistokes and at −60°F. (−55°C.) of 969 centistokes.

ALKOXYSILOXANE PREPARATION II

Another alkoxysiloxane useful in this invention was prepared as follows.

To a 2-liter; 3-neck flask was added 750 grams of dimethylsiloxane hydrolyzate and 250 grams of isodecanol mixture. The flask was equipped with a Dean Stark trap, water condenser, stirrer and automatic temperature controller. To the flask was added 90 ml. of xylene and 5 grams (0.5%) of KOH catalyst. The reaction vessel was heated to 150°C. and sparged to aid in the removal of the water-xylene azeotrope. After 3 hours the catalyst was neutralized and the crude product cooled and filtered. The product was stripped to remove the xylene and unreacted hydrolyzate. The product consisted of 96.3 percent of an alkoxysilane having the average formula:

$$C_{10}H_{21}O[(CH_3)_2SiO]_{10}C_{10}H_{21}$$

and 3.7% of unreacted isodecanol mixture. The product had a pH of 7.7 in a 50%-50% water-isopropanol mixture at 10% concentration. The product viscosity of 100°F. (37.5°C.) was 12.5 centistokes and 4.9 centistokes at 110°F. (98.5°C.). This corresponds to a viscosity-temperature coefficient of 0.61.

Viscosity-temperature coefficient is defined as:

$$\frac{\text{Viscosity in centistokes at 210°F.}}{\text{Viscosity in centistokes at 100°F.}}$$

ALKOXYSILOXANE PREPARATION III

The procedure described in Example 2 was repeated to prepare another sample of alkoxysiloxane. The amount of dimethylsiloxane hydrolyzate used was 625 grams and the amount of isodecanol mixture was 375 grams. After filtration and removal of the volatile components the product weighed 879 grams. The product pH was 7.1 in water-isopropanol. The product viscosity at 100°F. (37.5C.) was 8.7 centistokes and 3.1 centistokes at 210°F. (98.5°C.) corresponding to a viscosity-temperature coefficient of 0.64. The product consisted of 9% unreacted isodecanol mixture, 5% unreacted hydrolyzate and 86% alkoxysiloxane having the average formula:

$$C_{10}H_{21}O[(CH_3)_2SiO]_{8.2}C_{10}H_{21}$$

ALKOXYSILOXANE PREPARATION IV

The procedure described for Alkoxy Preparation II was used to prepare a sample of alkoxysiloxane from a straight chain alcohol, viz., n-decanol. n-Decanol and dimethylsiloxane hydrolyzate were reacted using the same mole ratio of reactants as used in Example 2. The resulting product had a viscosity temperature coefficient of 0.62. The product consisted of 7% unreacted hydrolyzate and 93% alkoxysiloxane having the average formula:

$$CH_3(CH_2)_9O[(CH_3)_2SiO]_{10.4}(CH_2)_9CH_3$$

EXAMPLES 1–4

A formulation was prepared consisting of 96% of the alkoxysiloxane prepared in Alkoxy Preparation I with 4% of tributyl Cellosolve phosphate. The formulation when subjected to the humidification DOT 5 test (6 days at −40°C.) showed a clear homogeneous liquid with no crystals or stratification evident. Rubber test values with neoprene cups at 100°C. for 70 hours showed a swell of −3.23% and with styrene-butadiene rubber (SBR) cups at 120°C. for 72 hours showed a swell of 0.29 inches. SAE specifications for volume percent swell on neoprene accept values between 0 to 6% swell. The DOT 5 diameter swell accepts a standard test cup swell of 0.006 to 0.055 inches.

This example was repeated with 94% of Alkoxysiloxane Preparation I and 6% tributyl Cellosolve phosphate. Again humidification showed a clear homogeneous solution with no stratification or crystals. The neoprene swell was 0.14 volume percent and (SBR) swell was 0.037 inches.

A third formulation was prepared from 91% of Alkoxysiloxane Preparation I and 8% of tributyl Cellosolve phosphate. The humidification test showed the formulation remained clear with no evidence of stratification or crystal formation. The neoprene rubber swell was +2.37 volume per cent and the SBR swell was 0.046 inches.

A fourth formulation was prepared from 46.5 parts of the Alkoxysiloxane Preparation II, 46.5 parts of Alkoxysiloxane Preparation I, and 7.0 parts of tributyl Cellosolve phosphate. The humidification test evinced a clear solution with no evidence of stratification or crystal formation. The neoprene rubber swell was +2.37 and the SBR swell was 0.044 inches.

These data are tabulated in Table 1 together with a list of Controls. These data demonstrate the criticality of the components in the hydraulic fluid composition of this invention.

The Controls in Table 2 demonstrate the criticality of the silicone component of the hydraulic fluid compositions of this invention. These data were obtained by preparing formulations based on another silicone which has the same internal structure but is terminated by methyl rather than alkoxy groups. This silicone is an alkyl siloxane which is commercially available and has the formula;

$$(CH_3)_3SiO[(CH_3)_2SiO]_xSi(CH_3)_3$$

where $x$ denotes the number of repeating units and is sufficiently high so as to afford products having viscosities of 50 to 100 centistokes.

It should be noted that both 1% tributyl Cellosolve phosphate and 10% tributyl Cellosolve phosphate are not even soluble in or compatible with this alkyl siloxane.

TABLE 1

PROPERTIES OF ALKOXYSILOXANE BLENDS

| Example | Control | Alkoxysiloxane | | Ester Additive | Rubber Swell[1] Neoprene | SBR | Blend Appearance After Humidification for 6 days at −40°C. |
|---|---|---|---|---|---|---|---|
| | A | 100% | Preparation I | None | −8.97 | 0.024 | Ice Crystals |
| 1 | | 96% | " | 4% of tributyl Cellosolve phosphate | −3.23 | 0.029 | Clear, no crystals |
| 2 | | 94% | " | 6% " | −0.14 | 0.037 | Clear, no crystals |
| 3 | | 92% | " | 8% " | +2.37 | 0.046 | Clear, no crystals |
| | B | 90% | " | 10% of trioctyl phosphate | −2.2 | 0.047 | Clear, very fine crystals |
| | C | 90% | " | 10% of di-2-ethylhexyl adipate | +1.40 | 0.067 | Ice crystals |
| | D | 90% | " | 10% of di-2-ethylhexyl sebacate | +2.63 | 0.076 | Hazy, crystals on bottom |
| | E | 95% | " | 5% of triaryl phosphate[2] | +9.33 | 0.076 | Milky, heavy precipitation |
| | F | 93% | " | 7%naphthenic oil[3] | −2.79 | 0.047 | Ice crystals |
| | G | 90% | " | 10% of methyl Carbitol | — | — | Not soluble, hazy separation. |
| | H | 85% | " | 15% of tridecanol | −1.3 | 0.052 | Ice crystals |
| | I | 90% | " | 10% of tetraethylene glycol octoate | +0.53 | 0.055 | Separation at bottom of tube |
| | J | 90% | " | 10% of triethylene glycol octoate | −1.3 | 0.045 | Hazy, very fine crystals |
| | K | 90% | " | 10% of dibutyl Carbitol formal | −0.1 | 0.051 | Hazy, fine shining crystals |
| | L | 90% | " | 10% dimethyl Cellosolve phthalate | NOT | SOLUBLE | — |
| | M | 90% | " | 10% diethoxy ethoxyethyl phthalate | − NOT | SOLUBLE | — |
| | N | 90% | " | 10% methyl Cellosolve acetyl recinoleate | + 4.7 | 0.067 | Hazy, crystals at bottom of table |
| | O | 90% | " | 10% dibutyl Cellosolve phthalate | − NOT | SOLUBLE | — |
| | P | 90% | " | | | | |
| 4 | | 46.5% | " | 7% dibutyl Cellosolve phosphate | +2.37 | 0.044 | Clear, no crystals |
| | | 46.5% | Preparation II | | | | |

[1]Rubber Swell test conditions: Neoprene volume Swell after 70 hrs. at 100° C. (SAE No. J-1703e) S&R Swell in inches of diameter of standard test cups (Motor Vehicle Safety Standard No. 116-DOT5)
[2]Cellulube 90 (Stauffer Chem. Co.)
[3]Calumet 5400 Oil from Calumet Refining Co.

TABLE 2

PROPERTIES OF ALKYL SILOXANE BLENDS

| Control | Alkyl Siloxane | Ester Additive | Rubber Swell [2] Neoprene | SRB | Appearance After Humidification for 6 days at −40°C. |
|---|---|---|---|---|---|
| Q | 100% [1] | None | −14.5 | — | Ice Crystals |
| R | 90% [1] | 10% trioctyl phosphate | +1.14 | 0.036 | Clear, very fine ice crystals |
| S | 93% [2] | 7% di-2- ethylhexyl sebacate | +1.75 | 0.044 | Ice crystals, cloudy |
| T | 90% [1] | 10% 2-ethylhexyl adipate | +4.7 | 0.061 | Hazy |
| U | 90% [1] | 10% triaryl phosphate [4] | NOT SOLUBLE | | |
| V | 99% [1] | 1% tributyl Cellosolve phosphate | NOT SOLUBLE | | |
| W | 90% [1] | 10% tributyl Cellosolve phosphate | NOT SOLUBLE | | |
| X | 93% [1] | % napthenic oil [5] | −1.5 | 0.052 | Very heavy flow |
| Y | 90% [1] | 10% dimethyl Carbitol adipate | NOT SOLUBLE | | Hazy separation |
| Z | 90% [1] | 10% tetraethylene glycol adipate | NOT SOLUBLE | | |

TABLE 2-continued

| Control | Alkyl Siloxane | PROPERTIES OF ALKYL SILOXANE BLENDS Ester Additive | Rubber Swell [2] Neoprene | SRB | Appearance After Humidification for 6 days at −40°C. |
|---|---|---|---|---|---|
| AA | 90% [1] | 10% triethylene glycol adipate | NOT SOLUBLE | | |
| BB | 90% [1] | 10% dibutyl Carbitol formal | NOT SOLUBLE | | |
| CC | 90% [1] | 10% dimethyl Cellosolve phthalate | NOT SOLUBLE | | |
| DD | 90% [1] | 10% di Carbitol phthalate | NOT SOLUBLE | | |
| EE | 90% [1] | 10% methyl Cellosolve acetyl ricinoleate | NOT SOLUBLE | | |
| FF | 90% [1] | 10% dibutyl Cellosolve phthalate | NOT SOLUBLE | | |

[1] $(CH_3)_3SiO[(CH_3)_2SiO]_xSi(CH_3)_3$ Where x is an integer denoting the number of repeating units and has a value which corresponds to a product having a viscosity of about 100 centistokes.
[2] Same as (1) except that the product has a viscosity of 50 centistokes.
[3] Rubber Test Swell conditions: Neoprene volume % Swell after 70 hours at 100°C. (SAE No: J-1703e). SBR Swell in inches of diameter of standard test cups (Motor Vehicle Safety Standard No. (16-DOT 5)
[4] Cellulube 90 from Stauffer Chem. Co.
[5] Calumet 5400 oil from Calumet Refining Co.

Although the invention has been described in the preferred forms, with a certain degree of particularity, it is understood that the present disclosure has been made only by way of example, and that numerous changes can be made without departing from the spirit and the scope of the invention.

What is claimed is:

1. Hydraulic fluid composition having excellent water tolerance at −40°C. which comprises:

A. about 50 to 99% by weight of an alkoxy-siloxane having the formula:

$$RO[(CH_3)_2SiO]_nR$$

wherein R is a monovalent hydrocarbon group or a mixture of monovalent hydrocarbon groups derived from an aliphatic alcohol or a mixture of aliphatic alcohols respectively, having the formula ROH, by removal of the hydroxyl group, said alcohol or mixture of alcohols having a boiling point above about 78°C. at atmospheric pressure, and $n$ is an integer having values of about 5 to about 200; and B. about 1 to about 50% by weight of a phosphoric acid ester having the formula:

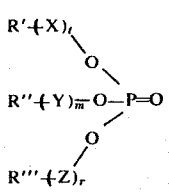

wherein each of R′, R″ and R‴ is a lower alkyl group having 1 to 4 carbon atoms, X, Y and Z are oxyalkylene units, including mixed oxyalkylene units having the formula:

$$-(OC_pH_{2p})-$$

wherein $t$, $m$ and $r$ are integers having values of 1 to 6 and $p$ is an integer havng values of 2 to 3.

2. Composition claimed in claim 1 wherein the value of $n$ in (A) is about 10 to 50 inclusive and wherein R contains about 2 to about 18 carbon atoms.

3. Composition claimed in claim 1 wherein the value of $n$ in (A) is about 10 to 50 inclusive and wherein R contains about 10 to 14 carbon atoms.

4. Composition claimed in claim 1 wherein the value of $n$ in (A) is about 10 to 50 inclusive and R is derived from a mixture of isomeric tridecanols.

5. Composition claimed in claim 1 wherein the value of $n$ in (A) is about 10 to 50 inclusive and R is derived from a mixture of isodecanols.

6. Composition claimed in claim 1 wherein the value of $n$ in (A) is about 10 to 50 inclusive and R is derived from a mixture of isodecanols and tridecanols.

7. Composition claimed in claim 1 wherein the value of $n$ in (A) is about 10 to 50 inclusive, and R is derived from 2-ethylhexanol.

8. Composition claimed in claim 1 wherein the value of $n$ in (A) is about 10 to 50 inclusive and R is derived from 3-methyl-1-butanol.

9. Composition claimed in claim 1 wherein the value of $n$ in (A) is about 10 to 50 inclusive and R is derived from isobutanol.

10. Composition claimed in claim 1 wherein the alkoxysiloxane is mixed with a minor amount of an alcohol or mixture of alcohols as defined in claim 1.

11. Composition claimed in claim 1 comprising about 95 to about 75% by weight of (A) and about 5 to about 25% by weight of (B).

12. A process for transmitting force in a hydraulic brake system of a vehicle having activating means, activated means, master brake cylinder means, and hydraulic line means connecting said activating means, said activated means and said master brake cylinder means, comprising applying mechanical force to said activating means, wherein said activating means, said activated means, said master brake cylinder means and said hydraulic line means are substantially filled with an hydraulic fluid composition which comprises:

A. about 50 to about 99% weight of an alkoxysiloxane having the formula:

$$RO[(CH_3)_2SiO]_nR$$

wherein R is a monovalent hydrocarbon group or a mixture of monovalent hydrocarbon groups derived from an aliphatic alcohol or a mixture of aliphatic alcohols, respectively, having the formula ROH, by removal of the hydroxyl group, said alcohol or mixture of alcohols having a boiling point above about 78°C. at atmospheric pressure, and $n$ is an integer having values of about 5 to about 200; and B. about 1 to about 50% by weight of a phosphoric acid ester having the formula:

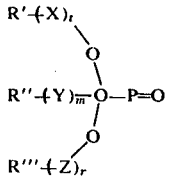

wherein each of R′,R″ and R‴ is an alkyl group having 1 to 4 carbon atoms and X, Y and Z are oxyalkylene units, including mixed oxyalkylene units having the formula:

$$-\!\!\left(OC_pH_{2p}\right)\!\!-$$

wherein $t$, $m$ and $r$ are integers having values of 2 to 4 and $p$ is an integer having values of 2 to 3.

* * * * *